US006280271B1

(12) United States Patent
Peterson

(10) Patent No.: US 6,280,271 B1
(45) Date of Patent: Aug. 28, 2001

(54) INFLATABLE SHADED FLOAT

(75) Inventor: LeRoy L. Peterson, Omaha, NE (US)

(73) Assignee: SportsStuff, Inc., Omaha, NE (US)

( * ) Notice: Subject to any disclaimer, the term of this patent is extended or adjusted under 35 U.S.C. 154(b) by 0 days.

(21) Appl. No.: 09/574,198

(22) Filed: May 18, 2000

(51) Int. Cl.[7] ..... B63B 35/58
(52) U.S. Cl. ..... 441/40; 441/129
(58) Field of Search ..... 441/40, 65, 66, 441/67, 129, 130, 131, 132, 38; 114/345, 346

(56) References Cited

U.S. PATENT DOCUMENTS

D. 399,552 * 10/1998 Peterson ..... D21/236
4,241,535 * 12/1980 Tsukuda ..... 46/250
5,358,438 * 10/1994 Wolfe ..... 441/129
5,458,517 * 10/1995 Ellis ..... 441/129
5,769,022 * 6/1998 Luxford ..... 114/361
6,142,844 * 11/2000 Klauber ..... 441/129

FOREIGN PATENT DOCUMENTS

00184476 * 7/1979 (EP) ..... 441/40

* cited by examiner

*Primary Examiner*—Stephen Avila
(74) *Attorney, Agent, or Firm*—Henderson & Sturm LLP

(57) ABSTRACT

An inflatable shaded float that includes a horizontal base upon which a number of users may sit or recline, a vertical support extending up from the base, and a horizontal canopy attached to the support to provide shade for a portion of the base. The base, support, and canopy are all inflatable so that the float may be entirely deflated to a compact package that is easily transported from one location to another. The support and canopy are shaped to give the appearance of the tail of a whale while making a dive.

10 Claims, 3 Drawing Sheets

INFLATABLE SHADED FLOAT

BACKGROUND OF THE INVENTION

1. Field of the Invention

The present invention relates to the field of water recreation devices, and more particularly to an air inflatable shaded float.

2. Description of Related Art

The prior art is replete with myriad and diverse water recreation devices that include a mechanism for providing shade. While all of the aforementioned prior art constructions are more than adequate for the basic purpose and function for which they have been specifically designed, they are uniformly deficient with respect to their failure to provide a simple, efficient, and practical inflatable shaded float.

As a consequence of the foregoing situation, there has existed a longstanding need for a new and improved inflatable shaded float and the provision of such a construction is a stated objective of the present invention.

BRIEF SUMMARY OF THE INVENTION

Briefly stated, the present invention provides an inflatable shaded float that includes a horizontal base upon which a number of users may sit or recline, a vertical support extending up from the base, and a horizontal canopy attached to the support to provide shade for a portion of the base. The base, support, and canopy are all inflatable so that the float may be entirely deflated to a compact package that is easily transported from one location to another. The support and canopy are shaped to give the appearance of the tail of a whale while making a dive.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
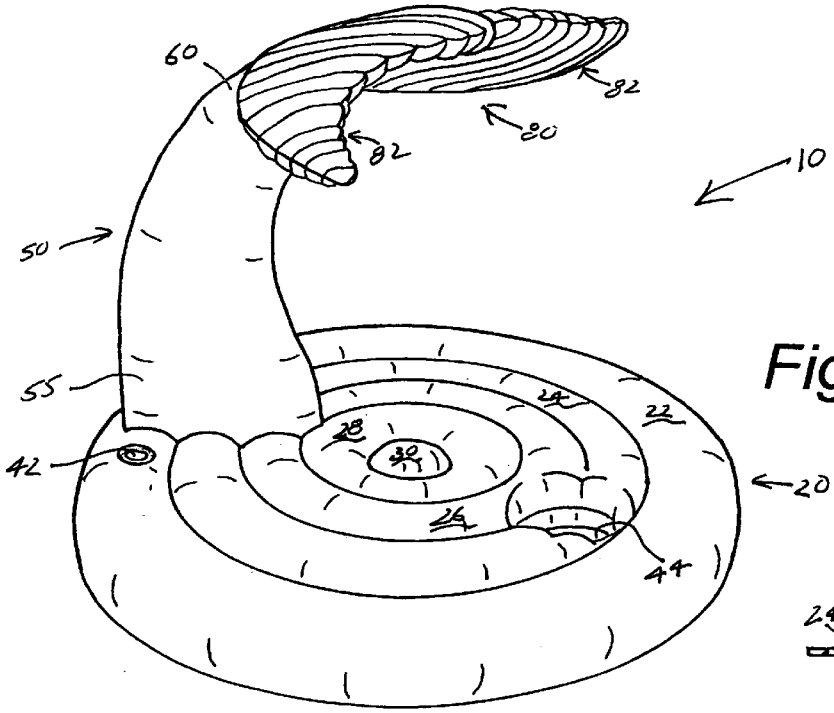
FIG. 1 is a perspective view showing the inflatable shaded float of the present invention.
Figure 3:
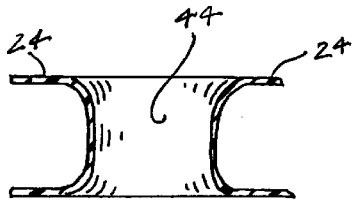
FIG. 3 is a sectional view taken along line 3—3 of FIG. 2 illustrating the open well that extends through the base.
Figure 2:
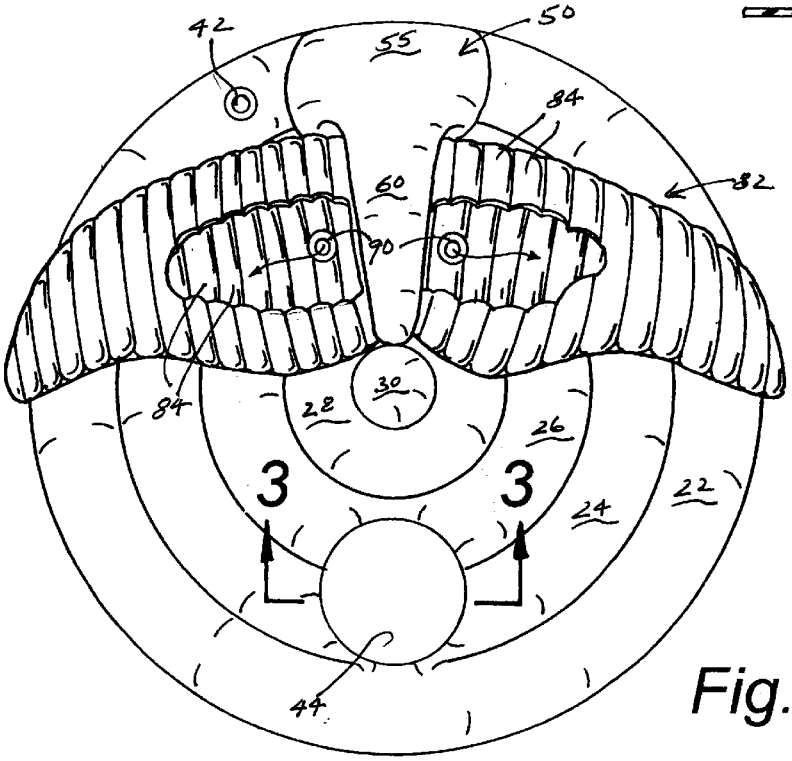
FIG. 2 is a top plan view thereof.
Figure 4:
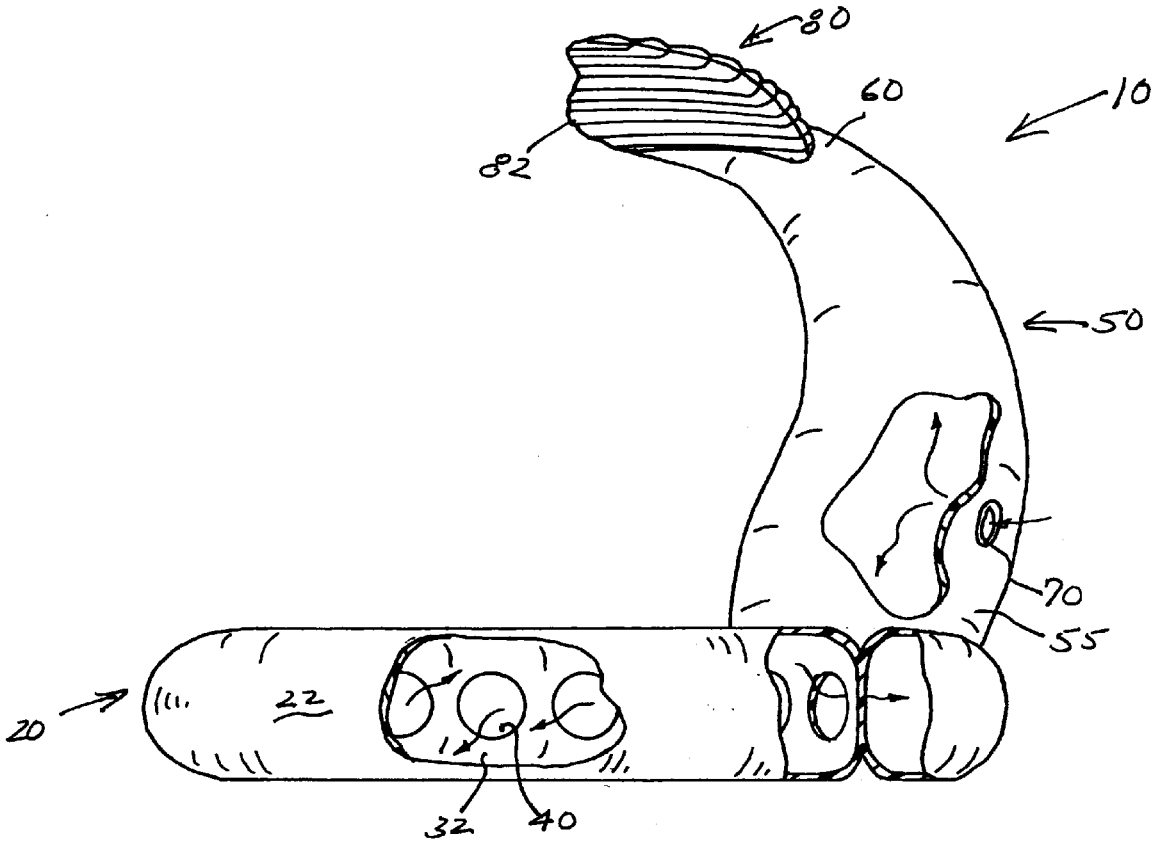
FIG. 4 is a side elevational view with portions cutaway to illustrate the inflatable chambers in the base and support.
Figure 5:
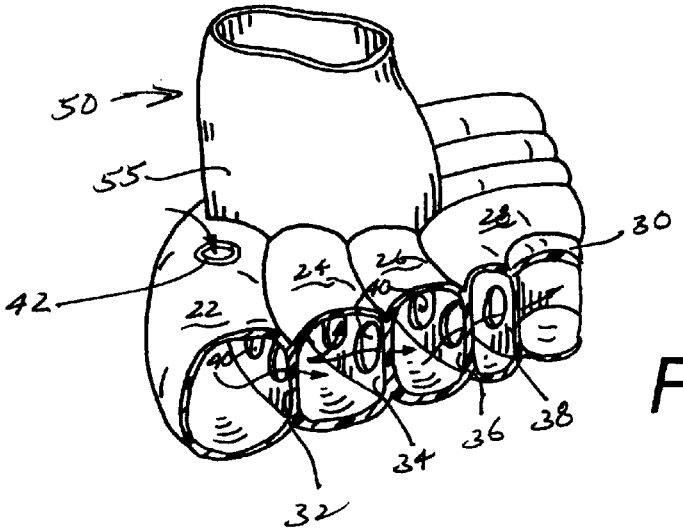
FIG. 5 is a partial perspective sectional view showing the inflation chambers.
Figure 6:
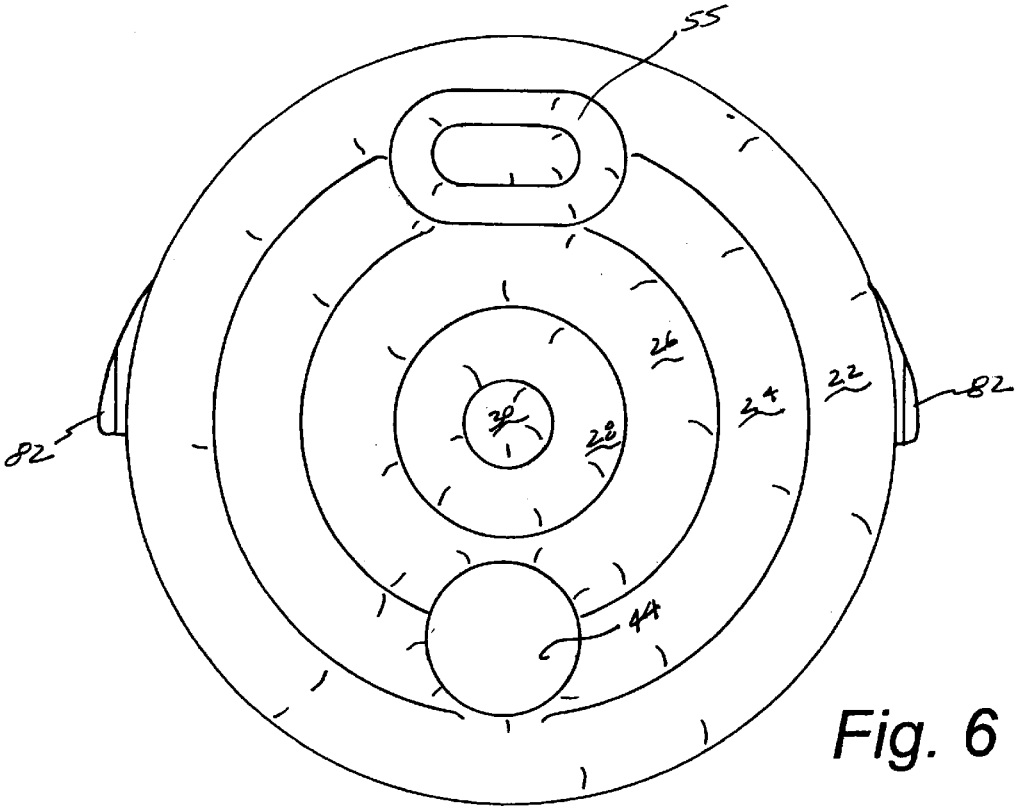
FIG. 6 is a bottom plan view of the float.
Figure 7:
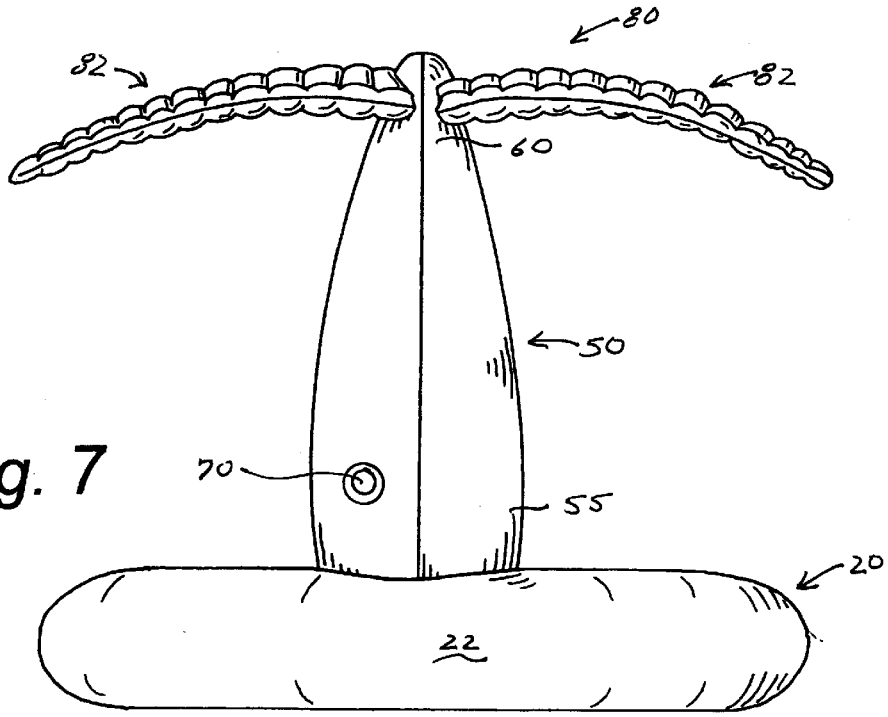
FIG. 7 is a rear elevational view thereof.

As can be seen by reference to the drawings, and in particular to FIG. 1, the inflatable shaded float that forms the basis of the present invention is designated generally by the reference number 10. The float 10 includes a horizontal base 20, a vertical support 50 extending up from one side of the base 20, and a horizontal canopy 80 extending out from both sides of the top 60 of the support 50.

The base 20 comprises a number of inflatable concentric rings 22, 24, 26, 28 disposed around an inflatable center 30. The center 30 and the rings 22, 24, 26, 28 are connected by webs 32, 34, 36, 38 with air flow openings 40 formed therein. An air inflation valve 42 is carried by the ring 22 to provide for the inflation of the entire base 20. An open well 44 extends through the base 20 on the side opposite the support 50.

The vertical support 50 extends up from one side of the base 20, and curves upwardly and inwardly toward the center 30. The support 50 is progressively narrowed from the bottom 55 to the top 60 and is formed in the shaped of a part of a whale's tail. An inflation valve 70 carried on the support 50 provides inflation of the support 50.

The canopy 80 is formed of two tail sections 82 that extend horizontally out from both sides of the top 60 of the support 50. Each tail section 82 includes a number of connected chambers 84 that all communicate with an inflation valve 90 carried on the underside of the tail sections 82. The tail sections 82 are formed in the shape of a portion fo a whale's tail.

Each of the base 20, the support 50, and the canopy 80 are individually inflatable. The float 10 may be transported in a number of fully or partially deflated configurations to suit a particular mode of transport. When fully inflated users may sit or recline on one side of the base 20 while being shaded from the sun by the canopy 80, or move to another side of the base 20 to be exposed to the sun.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An inflatable shaded float, comprising:

an inflatable horizontally disposed generally circular base;

an inflatable vertically disposed and radially aligned support attached to and extending up from the base; and, an inflatable horizontally disposed canopy attached to the support and extending outwardly therefrom wherein the canopy is vertically spaced over a portion of the base and disposed to shade the portion of the base from overhead sunlight.

2. The float of claim 1 wherein the base, the support, and the canopy are each inflated by separate inflation valves.

3. The float of claim 1 wherein the support is disposed on one side of the base.

4. The float of claim 3 wherein an open well is formed through the base on another side of the base opposite the support.

5. The float of claim 1 wherein the base includes a plurality of concentric inflated rings interconnected by webs having air flow openings formed therein.

6. The float of claim 1 wherein the support and the canopy are formed in the shape of a whale's tail.

7. The float of claim 2 wherein the support and the canopy are formed in the shape of a whale's tail.

8. The float of claim 3 wherein the support and the canopy are formed in the shape of a whale's tail.

9. The float of claim 4 wherein the support and the canopy are formed in the shape of a whale's tail.

10. The float of claim 5 wherein the support and the canopy are formed in the shape of a whale's tail.

* * * * *